US005579684A

United States Patent [19]

Stribling

[11] Patent Number: 5,579,684

[45] Date of Patent: Dec. 3, 1996

[54] EFFICIENT COMPACTION SYSTEM

[75] Inventor: Robert P. Stribling, Monroe, Ga.

[73] Assignee: Stribling Systems, Inc., Stone Mountain, Ga.

[21] Appl. No.: 263,680

[22] Filed: Jun. 22, 1994

Related U.S. Application Data

[63] Continuation-in-part of Ser. No. 23,126, Feb. 26, 1993, Pat. No. 5,348,125.

[51] Int. Cl.[6] ..... B30B 15/16

[52] U.S. Cl. ..... 100/48; 100/229 A; 100/240; 100/269.01; 100/269.14

[58] Field of Search ..... 100/48, 229 A, 100/269 R, 240, 269.01, 269.14, 215, 233, 269.17, 214; 60/911

[56] References Cited

U.S. PATENT DOCUMENTS

| | | | |
|---|---|---|---|
| 2,611,246 | 9/1952 | Ackerman | 60/911 |
| 3,318,231 | 5/1967 | Felts | 100/269 R |
| 3,788,076 | 1/1974 | Lansky et al. | 60/911 |
| 4,147,100 | 4/1979 | Dykstra | 100/229 A |
| 4,188,872 | 2/1980 | Chrablow | 100/229 A |
| 5,001,978 | 3/1991 | Discepolo | 100/229 A |

FOREIGN PATENT DOCUMENTS

| | | | |
|---|---|---|---|
| 2532284 | 3/1984 | France | 100/214 |
| 1957021 | 6/1970 | Germany | 100/229 A |
| 3412614 | 10/1985 | Germany | 100/269.17 |
| 1539710 | 1/1979 | United Kingdom | 100/233 |

*Primary Examiner*—Stephen F. Gerrity
*Attorney, Agent, or Firm*—Randy W. Lacasse

[57] ABSTRACT

A portable waste container having a built-in DC-to-hydraulic power converter and hydraulic compaction system to provide for efficient waste management. The hydraulic power converter is connected to a source of electrical power, preferably a vehicle battery by jumper cables located within the portable waste container. A telescoping cylinder ram and platen mechanism use power obtained from the DC-to-hydraulic conversion to compact the waste. The opening of the waste container has a second angled side which rests above the platen to both increase the traditional opening size and decrease the pressure of compacted trash against the top of the platen therefore reducing the amount of waste returning back into the hopper section after compaction.

14 Claims, 6 Drawing Sheets

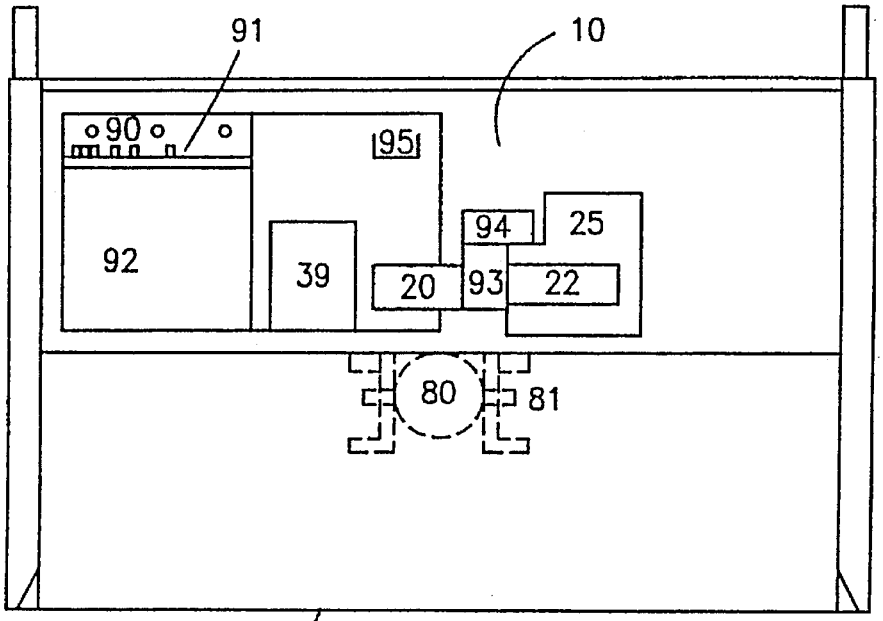
FIG. 6
FIG. 7
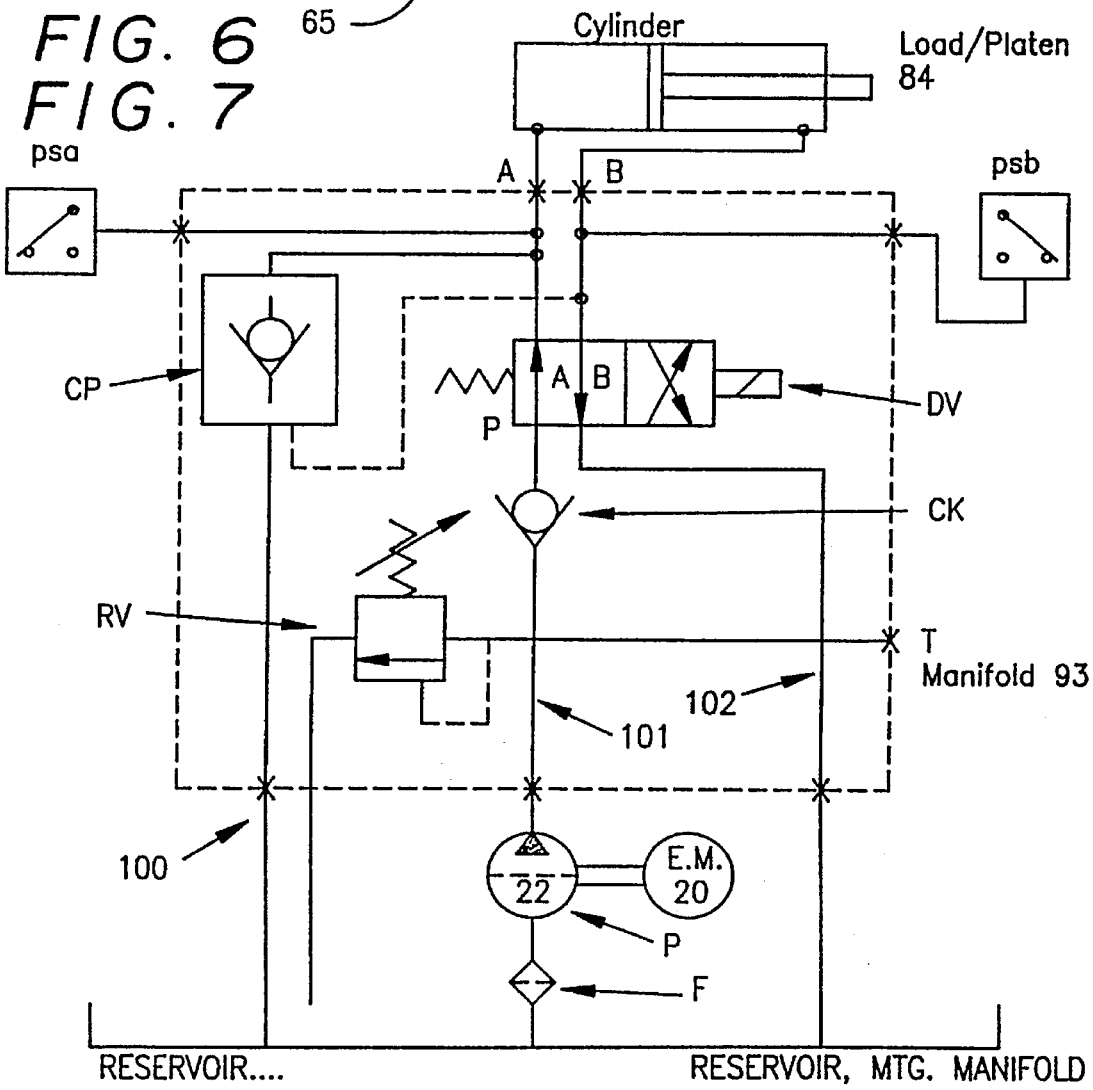

EFFICIENT COMPACTION SYSTEM

This application is a Continuation-In-Part of U.S. application Ser. No. 08/023,126, filed Feb. 26, 1993 U.S. Pat. No. (5,348,125), entitled SELF-CONTAINED HYDRAULIC POWER UNIT FOR WASTE COMPACTOR CONTAINERS.

BACKGROUND OF THE INVENTION

1. Field of the Invention

The present invention relates to electro-hydraulic conversion systems, and more particularly to providing hydraulic power to waste compaction systems 2. Description of the Prior Art Hydraulic compactors are frequently used in the collection and disposal of waste. The classic example of such a hydraulic waste compactor is a waste removal truck, such as is found in U.S. Pat. No. 3,941,263 to Clucker et al., entitled "Method for Controlling the Packer Blade of a Refuse Truck." Such trucks typically use the truck engine as the source of power to drive the hydraulics of the waste compactor. Other prior art devices of this type are demonstrated by U.S. Pat. No. 3,802,585 to Churchman, entitled "Compactor for Refuse or Other Compressible Material," and U.S. Pat. No. 5,015,144 to Smith et al., entitled "Apparatus for Loading Material Into a Storage Compartment and Associated Fluid Pressure Delivery System." Again, these systems utilize the truck as the source of power for the hydraulics, and the container for holding waste is not separable from the truck.

Another apparatus frequently used in removal of waste is onsite waste containers. The waste containers are either periodically emptied by the prior art trucks as discussed above, or are removed as a unit, and taken to the waste disposal site. The problem with these prior art systems is that each suffers from the frequency with which the trucks must tend to the waste container. The sheer volume of waste which has not been compacted can result in requiring the disposal truck to frequently visit the site where the trash container is located, or the requirement of numerous containers. Either alternative is costly.

Compacting-type waste disposal dumpsters are becoming increasingly popular in waste management because of their ability to compact waste into a smaller volume prior to pick-up and disposal. As shown in FIG. 1, prior art units or "compactor containers" typically include a large storage bin or container 8, a hopper 9 generally mounted at one end of the container, and a hydraulically-actuated compactor 11. The compactor 11 powers a compressing ram 14 that compresses waste placed into the hopper 9 and forces the compacted waste into the container 8.

In most applications, power for the hydraulic compactor 11 is provided from a source associated with a building or other permanent facility, such as a power unit 13 comprising a 220 VAC-powered hydraulic compressor. Hydraulic hoses with quick connect/disconnect fittings 12 are used to connect pressurized hydraulic fluid to the compactor 11. When the bin 8 is full, the compactor 11 is disconnected from the hydraulic source and the whole container 8 including hopper 9 and compactor 11 is transported by truck to a waste disposal site. In an alternate method, the container is disconnected from the compactor and then transported.

One particular impediment to the use of such waste compactor containers is the difficulty of obtaining power. Many facilities needing waste compaction do not have 220 VAC; alternative power sources may not be readily available. Typical examples include construction sites, rural county dumpster sites and recycling sites.

It is known in the prior art to provide for portable sources of hydraulic power, such as that shown in U.S. Pat. No. 4,211,080 to White, entitled "Hydraulic Power Packs." White discloses a gasoline portable hydraulic unit. Having the actual power source on the portable unit, in addition to the apparatus for converting the power from the power source to hydraulic power results in a large, cumbersome portable unit. A system such as demonstrated by White also requires the user to provide hydraulic hoses for connection to the tools.

The preferred embodiment of White demonstrates the use of a petrol engine power source. Such a power source suffers from the large number of mechanical parts, which frequently results in costly breakdowns, and therefore requires regular maintenance and service including tune-ups, replacement of worn parts, replacement of fuels and lubricants.

If a gasoline engine is used for the purpose of trash compaction, a very large engine, like that of the White reference, would be necessary to provide the torque necessary for proper operation. Because of the gasoline used in the engine, the unit could not be permanently attached to the side of a compactor system because when the system was tilted, the gas and oil would leak out of the apparatus during emptying of the container. A gas engine system would also not hold well in the harsh environment associated with waste products, including dust and weather.

SUMMARY OF THE INVENTION

It is an object of the present invention to provide for a unique waste compaction power system which overcomes the deficiencies in the prior art as outlined above.

It is another object of the present invention to provide for a portable waste compaction system.

It is another object of the present invention to provide for a unique portable waste container's receiving opening (hopper).

It is another object of the present invention to provide for an efficient compactor with a unique hydraulic return system.

It is another object of the present invention to provide for a unique electronic circuit controller for the system.

These objects and advantages are carried out by a portable waste container having a built-in DC-to-hydraulic power converter and hydraulic compaction system to provide for efficient waste management. The hydraulic power converter is connected to a source of electrical power, preferably a vehicle battery by jumper cables located within the portable waste container. A telescoping cylinder ram and platen mechanism use power obtained from the DC-to-hydraulic conversion to compact the waste. The opening of the waste container has a second angled side which rests above the platen to both increase the traditional opening size and decrease the pressure of compacted trash against the top of the platen therefore reducing the amount of waste returning back into the hopper section after compaction.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 6 illustrates an end view cutaway of the portable compaction system.

FIG. 7 illustrates the hydraulic system of the present invention.

DESCRIPTION OF THE PREFERRED EMBODIMENTS

The detailed embodiments of the present invention are disclosed herein. It is to be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

It should be kept in mind that the term "waste" should be considered broadly to include, but not be limited to, material to be recycled, liquid, and in general, any materials requiring disposal. Moreover, the invention may be considered useful in other fields where compression of materials is necessary.

Figure 1:
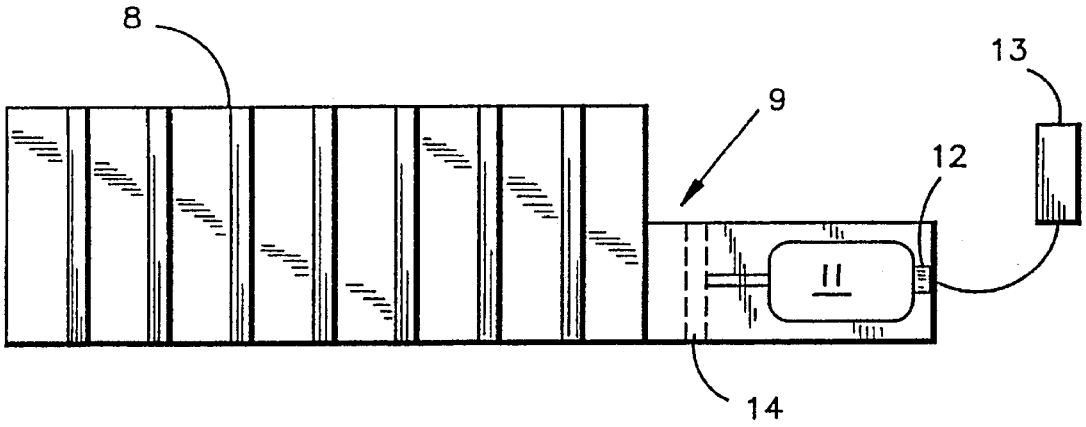
FIG. 1 (PRIOR ART)
FIG. 1 is a prior art device demonstrating a hydraulic waste container.
Figure 2:
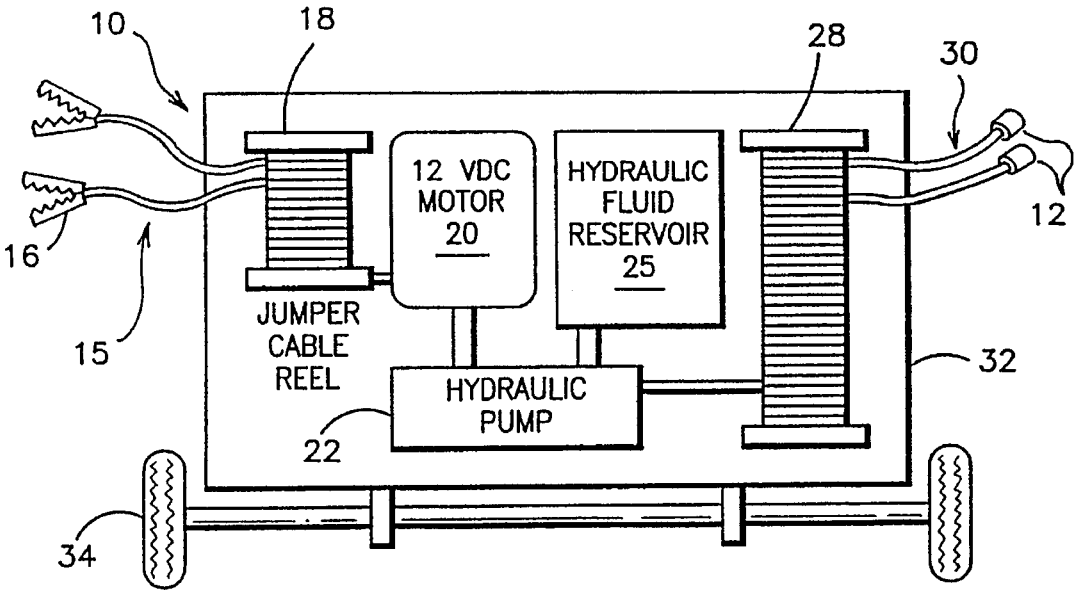
FIG. 2 details a preferred embodiment of the present invention showing a portable hydraulic system with external electric and hydraulic connectors.

As shown in FIG. 2, the present invention provides a portable and self-contained 12 volt DC (VDC) portable hydraulic apparatus 10 for compactor containers. While the preferred embodiment is shown using 12 VDC, other equivalent power sources are contemplated, including other DC voltages. The portable hydraulic apparatus 10 is operative to connect to the 12 volt battery terminals (not shown) of an automobile (not shown) via a pair of jumper cables 15 that include clamps 16 for clamping onto the terminals. An internal jumper cable reel 18 allows the jumper cables 15 to be extended or retracted as desired. The storage could also be implemented by any other known apparatus which is capable of extending and retracting the cables. In addition, the electrical connection could also be a plug-type system, or any suitable electrical connection necessary for the type of DC power available at the site.

Electrical power from the automotive battery is provided to a 12 volt DC motor 20 that powers pump 22. Advantageously, the vehicle-to-hydraulic apparatus connection may have an indicator light for indicating that the connection is complete. Battery power can also be derived from an on-board battery (not shown). In the preferred embodiment the on-board battery is electrically connected in parallel with the external battery to reduce the amperage requirements of the external system. It helps to maintain the voltage at 12 Volts during heavy use.

The electric motor could be of any type suitable for taking DC power and driving the hydraulic system. For example, the motor could be a 12 VDC motor operating at 3350–3600 RPM, having amperage of 170–200 amps. A typical duty cycle would be 60%+.

The hydraulic pump 22 receives fluid from a hydraulic fluid reservoir 25 and provides pressurized hydraulic fluid to one or more hydraulic hoses 30, including quick connect/disconnect fittings 12 located at the distal end of said hoses. An internal hose reel 28 allows the hydraulic hoses to be extended or retracted as desired.

The entire portable hydraulic apparatus 10 may be enclosed within a housing 32 and mounted on wheels 34 for portability. The housing for the portable device can be any conventional housing, providing support and protection from the elements.

Alternatively, in a secondary embodiment (FIG. 3*b*) the unit may be removably or permanently mounted on the compaction unit itself. The hydraulic power unit in a third embodiment (FIG. 5–6) can further be made to be an integral part of the compaction system, residing inside the compactor housing 9.

The conversion of electrical energy to hydraulic energy can be carried out by any well-known conversion device.

To use the portable hydraulic apparatus 10, a suitable automobile or truck is driven to the site where a compactor container 8 is present and compaction is needed. The hydraulic hoses 30 are connected to the compactor 11 through connectors 12. The jumper cables 15 or plug system (not shown) are connected to the battery of the vehicle, and the vehicle is left running to generate 12 VDC. The compactor then compresses the waste contained in the bin 9. Upon completion of compaction, the portable hydraulic apparatus 10 may be disconnected and removed from the site. Alternatively, the device could be left attached to the compaction device.

Figure 3A:
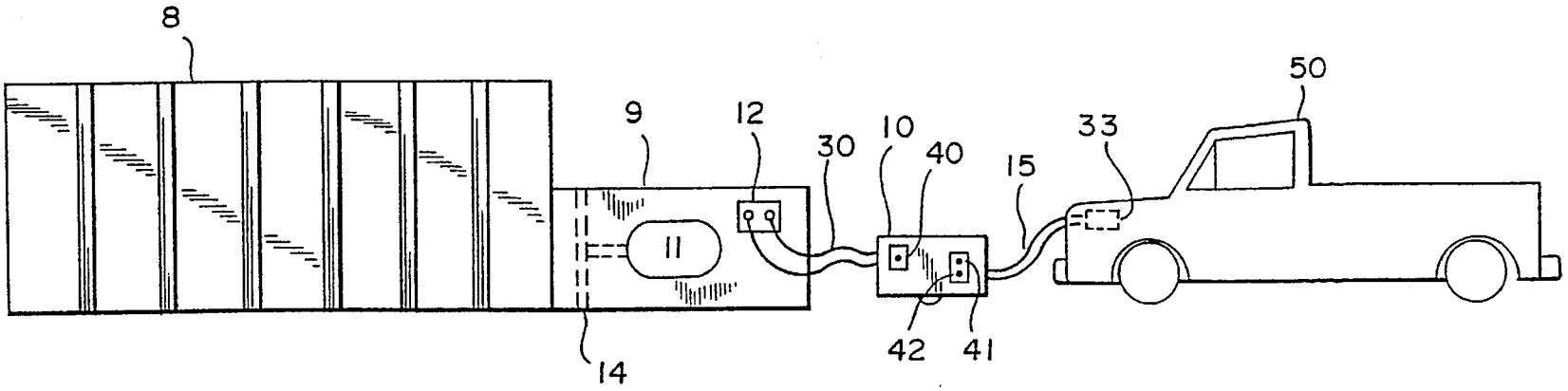
FIG. 3*a* details the use of the portable hydraulic apparatus deriving power from a vehicle battery, and powering the prior art device of FIG. 1.

FIG. 3*a* shows the preferred embodiment which demonstrates a portable hydraulic apparatus 10 of the instant invention. In FIG. 3*a*, the portable hydraulic apparatus 10 is connected to an external power source, which is shown as a vehicle 50. The portable hydraulic apparatus 10 may also derive power from a variety of other sources, which may or may not be stationary. In this instance, the vehicle provides 12 VDC from the vehicle battery 33 to the portable hydraulic apparatus 10 via electrical conduit 15.

The remaining portion of FIG. 3A comprising hoses 30, and the components of the prior art device 8 as previously described above.

The system allows for draws of high amperage from a vehicle or extra batteries. From this, two or more horsepower can be maintained for long periods of time.

Figure 3B:
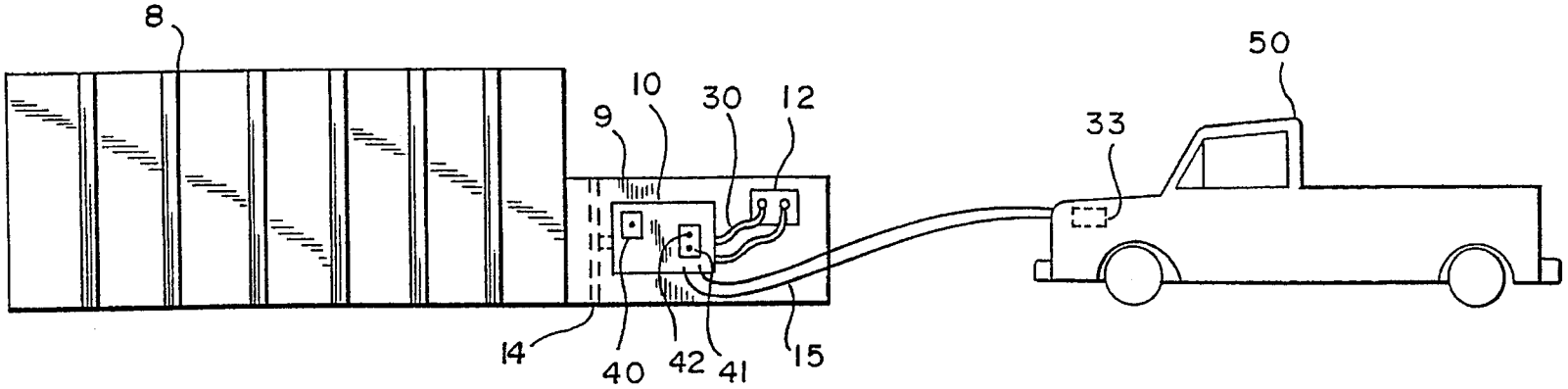
FIG. 3*b* details the use of the hydraulic apparatus deriving power from a vehicle battery, and attached to and powering the prior art device of FIG. 1.

FIG. 3*b* details a second embodiment wherein the hydraulic apparatus 10 is either attached to, or made an integral part of, (FIG. 5–6) the waste compaction device 9. The attachment can be made by any known means for attaching devices to each other. For example, the device could be bolted onto the waste compaction device, or a system of brackets or tongue-and-groove combinations could be made to removably mount the system onto a plurality of waste compaction devices.

Figure 4:
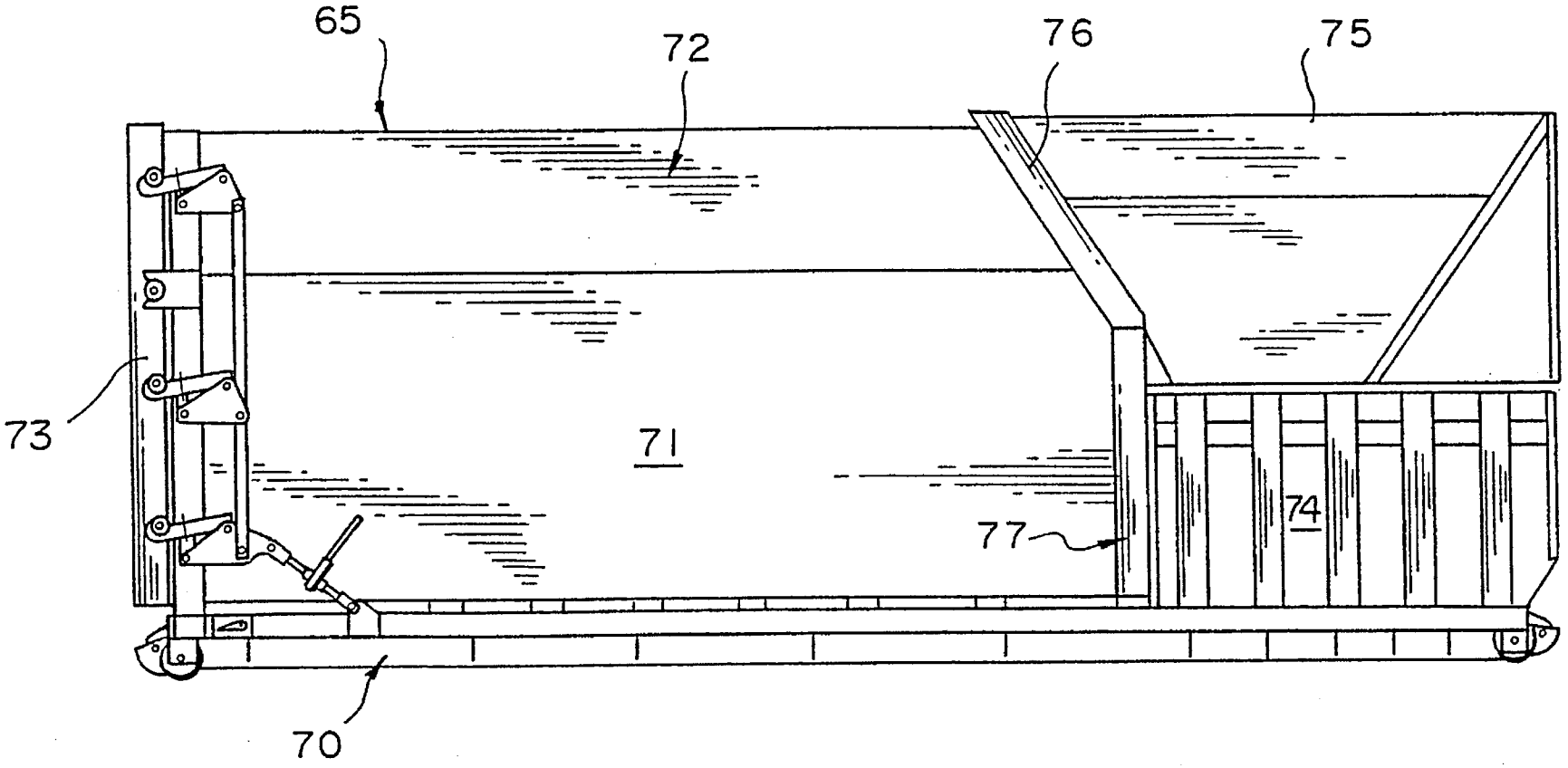
FIG. 4 illustrates an alternative implementation of the portable hydraulic waste container of the present invention.

In a preferred implementation of this secondary embodiment, FIG. 4 illustrates a portable waste compactor 65 having: a base 70 with wheels for moving the device; a waste storage receptacle 71 with upper inwardly angled section 72; a door 73 attached by hinges for emptying the storage receptacle 71; a section 74 containing the platen, telescoping cylinder ram and the DC hydraulic power unit 10 of the present invention see (FIG. 5); a hopper 75 for receiving waste product and a unique angled section 76 which both facilitates waste product loading by creating a larger opening for the hopper 75 and further by decreasing the pressure of accumulated compacted trash at the platen opening 77. By decreasing the piling up of trash above the opening 77 less trash will fall back into section 74 when the platen is returned after a compaction cycle.

Figure 5:
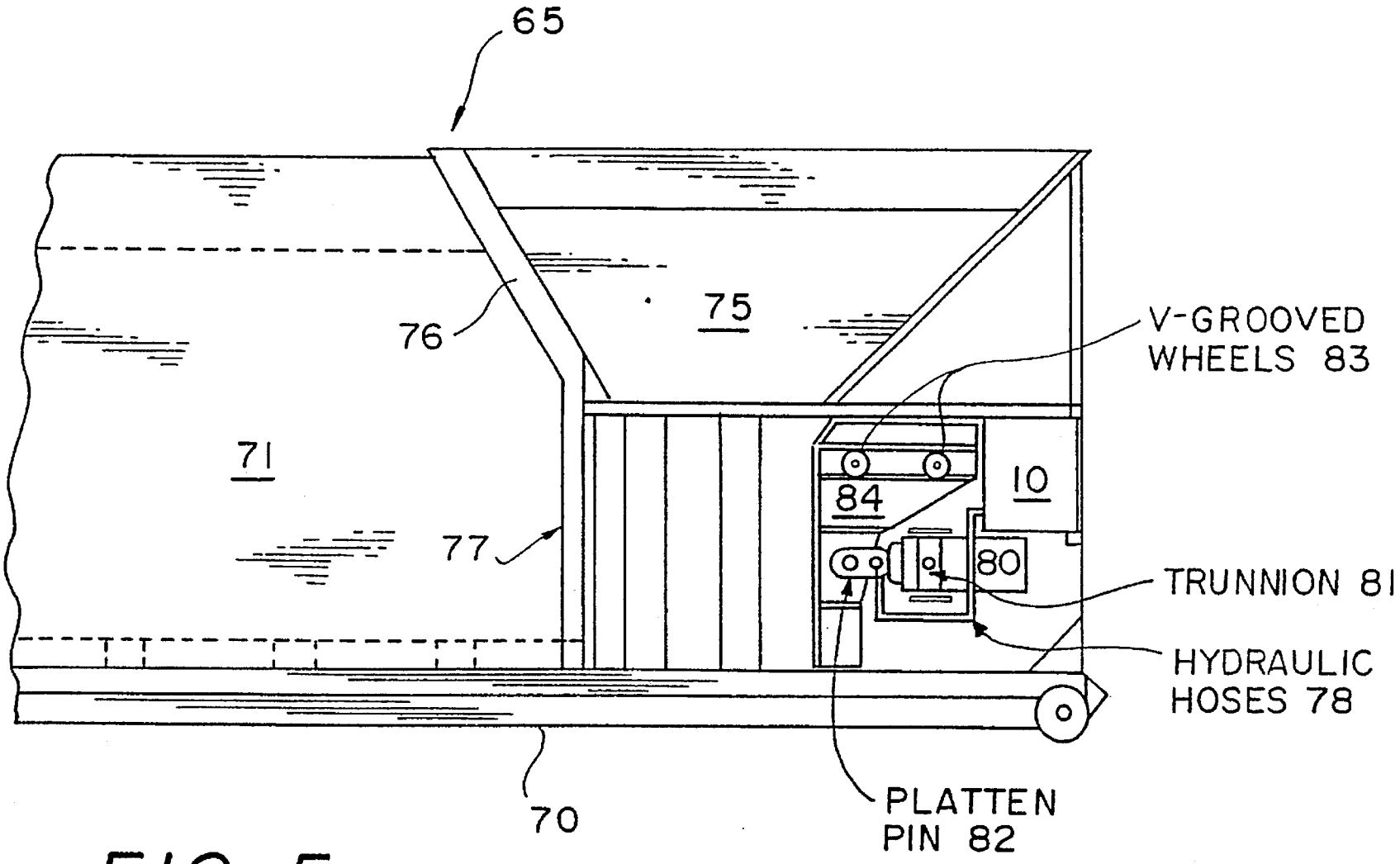
FIG. 5 illustrates a cutaway of the portable hydraulic waste container of the present invention showing the internal compaction and power systems.
Figure 8:
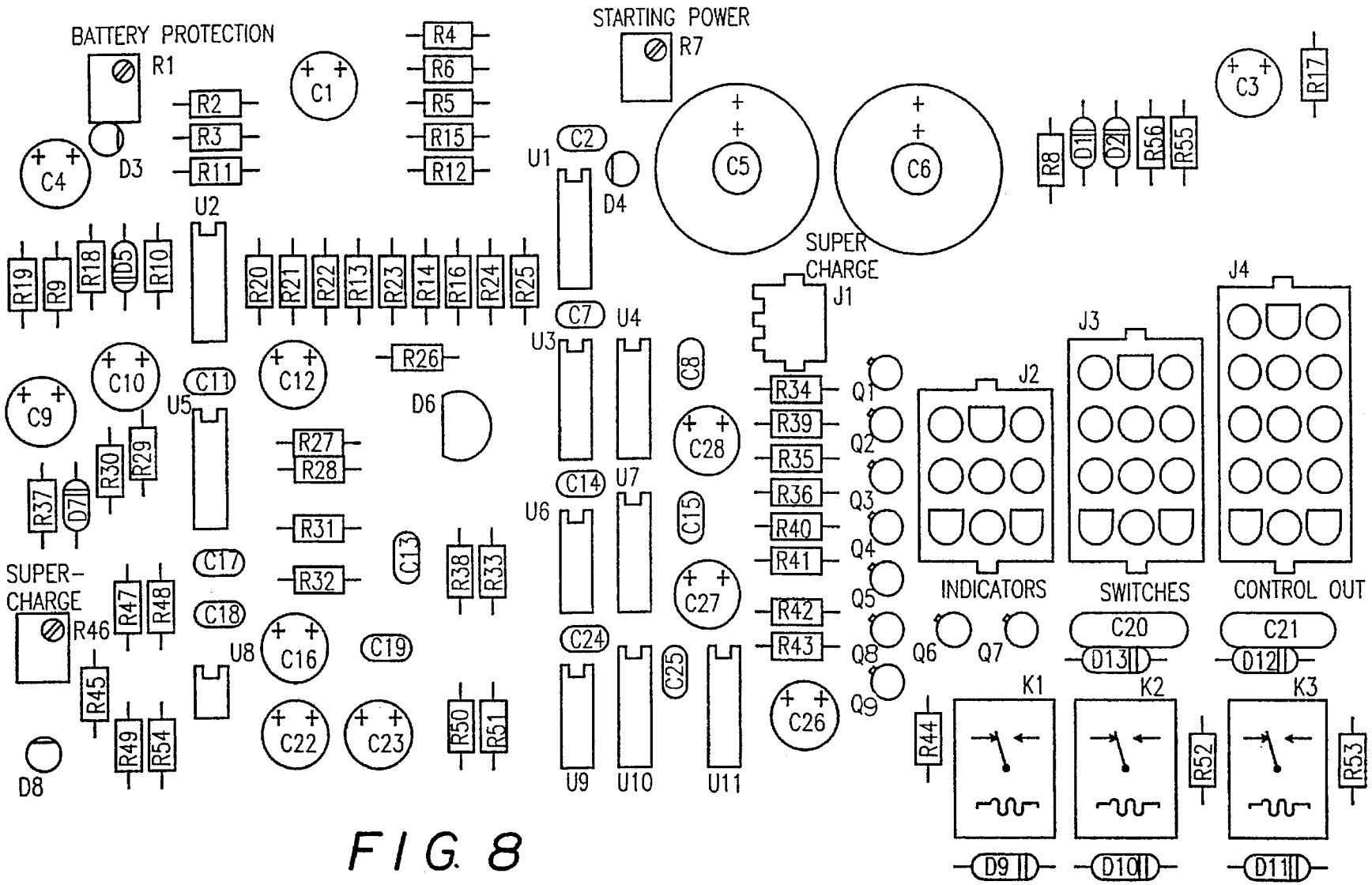
FIG. 8 illustrates the compactor controller circuit board of the present invention.

FIG. 5 illustrates a side view cutaway of the portable waste container 65. In operation, the power unit 10 receives DC power from an external source (as previously described) converts the electrical power to hydraulic power which actuates, through hoses 78, a double acting telescoping cylinder 80, attached by a cross support trunnion 81. The telescoping cylinder 80 is attached to platen 84 by platen pin 82. Upon positive activation (i.e. compaction cycle) the telescoping cylinder extends outwardly (right-to-left in FIG. 5) forcing the platen 84 past opening 77 and into storage section 71 to compact the trash. Upon negative activation (i.e. return cycle ) the telescoping cylinder returns to its original resting position as shown in FIG. 5. Note, the platen travels on V-grooved wheels 83 as is generally known in the art.

FIG. 6 illustrates an end view cutaway of this preferred implementation of this embodiment. A control panel 90, circuit board controller 91 and cable storage compartment 92 are accessible by a exterior covering door (not shown). In this implementation the power unit is generally the same as shown in FIG. 2–3 with the hydraulic pumps 22 being placed inside the hydraulic reservoir 25 and the inclusion of a unique hydraulic manifold 93, control valve 94 and secondary battery 39. Motor switch 95 controls motor 20.

FIG. 7 is a schematic of hydraulic manifold 93 in co-action with the telescoping cylinder 80. In operation, pressurized hydraulic fluid is forced into the cylinder through port A, extending the cylinder, 80, and is returned through activation of port B, retracting the cylinder. Pressure switches PSA and PSB regulate pressure in the ports. Check valve CP is a pilot which detects an increase in pressure in the return from port "A" (i.e. during retraction). The check valve opens an auxiliary return line 100 which allows for very rapid reduction of the pressure in the cylinder port A. A decrease in pressure of the fluid returning from A requires less pressure in the fluid used by port B to return the cylinder to its original non-extended position. This two return line feature greatly reduces the energy and time required to return the cylinder to starting position.

The system further includes check valve CK, 4-way, SPG. offset, 4-way solenoid valve DC, pressure relief RV and filter F and fluid lines for A and B ports (101 and 102 respectively).

FIG. 9 illustrates a preferred implementation of the electronic circuit board controller 91, but should not be limited thereto. Functionally equivalent systems could be used.

1.0 SCOPE

The controller circuit board was designed to provide a means to control, and monitor the progress of a hydraulic actuator, and control the charging, and discharging of a local lead/acid battery. Two modes of operation are available. Single cycle, where the cylinder is extended and retraced once, as allowed by the rules of battery charge and three cycle mode, where the same above described cycle is simply repeated three times. Progress monitoring via indicator lamps is provided to count cycles, and display status of battery charge. 4000 series CMOS digital IC'S, discrete transistors, mechanical relays, and analog comparators are used to form the state machine, detect input signals and produce output commands.

1.1 PHYSICAL DESCRIPTION

The printed wiring board is 4 inches by 8 inches, fabricated on a standard 0.093 inch thick FR-4 (fiberglass) double sided printed circuit board material. Standard commercial assembly practices are used in assembly of the controller. The finished assembly has a conformal coating to assist survival in the expected harsh environment.

Status LED'S may optionally be installed on the printed wiring board to aid in repair of the assembly.

The operating temperature range is 0 to +70 degrees C. All voltages given in this document have ±2 volt tolerance. All times given in this document have ±50% tolerances.

2.0 CIRCUIT BY CIRCUIT DESCRIPTION

The theory of operation of the compactor control is described in two parts. A major section describes the cylinder control state machine section. The second section describes the support circuits.

2.1 CYLINDER CONTROL STATE MACHINE

Upon power up, the state machine is waiting for power available, the cycle pending latch is set, the cycle counter is set to the first cycle, and cylinder direction is commanded to extend. Upon power available, the motor is commanded on. Upon detection of the fully extended pressure signal, or the retract command from a push button switch, the state machine commands cylinder direction to the retract position. Upon detection of the fully retracted pressure signal, or optional slide retracted position sensor, the state machine commands motor off, the cycle counter is advanced and the cylinder direction is commanded to extend. The cycle pending latch is reset either by the retracted over-pressure signal in the cycle mode, or the retracted over-pressure signal and the three count from the cycle counter in the three cycle mode. If the cycle pending latch is set, then the cycle repeats.

NOTES:

1) Cylinder direction command from retract to extend may optionally be delayed by one second by installing C9 to allow pressures in the hydraulic system to equalize.

2) Indicator lamp outputs are available to indicate cycle number when the three cycle mode is selected. Cycle indicator lamps are inhibited in the one cycle mode.

2.2 CONNECTORS

Four connectors are provided for ease of installation.

J1 provides the connection for the supercharger.

J1 pin 2 is connected to ground to request full charge from the battery charger system.

J2 provides all connections for all operator indicator lamps. Six indicator lamps are available. Three lamps indicate the number of cycles remaining in the three cycle mode and three lamps indicate the state of the battery charge.

J3 provides all connections for all operator switches. Three switches are standard. The power and mode select switch is a three position switch, center off, with the ability to select either the one, or three cycle modes of operation. A retract switch is provided to command the cylinder to retract. The emergency stop switch is provided to interrupt all power from the battery, except the high current connection to the final motor control relay. J4 provides all connections to the battery, pressure and position sensors, and the controlled elements of the compactor.

2.3 POWER SUPPLY

D1, D2, R8 and C5 make up the power input and filter. This is needed to suppress the large voltage dropout that is caused by motor start.

2.4 VOLTAGE REFERENCE

D6 and it's associated parts form a voltage reference that is intended to be stable within 2% over the temperature range 0 to +70 degrees C. The high stability is needed because the compared voltages are divided (worst case) by 6 therefore reference voltage error will seem to be multiplied by 6 at the comparators.

2.5 POWER ON RESET CIRCUIT

R32 and C16 and a comparator create a 0.5 second delay used as a reset signal. This holds any level sensitive logic during power up, and forces initial state of the latches in the state machines.

2.6 BATTERY PROTECTION CIRCUIT

The comparators motor can be paused if needed to prevent damage to the local battery. A signal called battery -OK is generated and used. The battery-ok signal goes false when the battery voltage(sensed locally on the filtered supply) falls below 10.7 V, for more than 1 second. The battery is considered OK when it is able to be charged to 14.7 V. Battery protect will simply pause the motor where it is in the cycle, if needed, to give the battery time to charge. The cycle will simply resume where it left off when the battery is considered to be charged. An indicator lamp output is available to display the state battery-ok signal. The set point of the voltage detector is selected by a voltage divider made up of 1%, ±100 PPM/degree C metal film resistors R2 and R3. These stable fixed resistors may be optionally replaced by a less stable, but adjustable potentiometer R1.

2.7 STARTING POWER AVAILABLE

Starting power available is intended to reflect the local battery's state of charge. It works on the theory that charging voltage measured across the battery is proportional to the amount of charge in the battery. The voltage sensed locally on the printed wiring boards' filtered supply by comparing the supply voltage with a reference voltage. The battery is considered to be fully charged when the charger can produce 14.7 volts across the battery. The output of the starting power available circuit is low when power is insufficient, and is the output of a monostable multivibrator (U2C) when battery charge is OK. The multivibrator is used because a state machine could miss a single rising edge, if it is busy or held reset when starting power becomes available. Indicator lamp outputs are available to display the state of the starting power available signal. The set point of the voltage detector is selected by a voltage divider made up of 1%, ±100 PPM/degree C metal film resistors R4 and R6. Fine adjustment of the voltage set point may be accomplished by adding a selected value resistor in either R58 or R59 position. These stable resistors may be optionally replaced by a less stable, but adjustable potentiometer R7.

2.8 SUPERCHARGER

The supercharger circuit is intended to control an external battery charging system that is equipped with a remote charge rate control input. This circuit connects the chargers control input to ground thru a 10 AMP dry contact to request maximum charge capability from the charging system. The supercharger circuit will request full charge until the battery voltage reaches 14.0 volts. This circuit will release the charging system from full charge for a minimum of 20 seconds to prevent excessive wear on the dry contacts. The set point of the voltage detector is selected by a voltage divider made up of 15, ±100 PPM/degree C metal film resistors R47 and R54. These stable fixed resistors may be optionally replaced by a less stable, but adjustable potentiometer R48.

Advantageously, the portable or internal hydraulic power apparatus 10 can be used with a variety of power sources as well as a variety of waste compaction devices, or even other hydraulic-actuated devices.

CONCLUSION

While various preferred embodiments have been shown and described, it will be understood that there is no intent to limit the invention by such disclosure, but rather, is intended to cover all modifications and alternate constructions falling within the spirit and scope of the invention as defined in the appended claims.

For instance, the invention is not limited to any particular power requirements within, into, or out of the device. Nor is it limited by any precise physical configuration including size, shape or overall design. Equivalent compaction cylinders, platens, hydraulic control systems and electronic circuit boards (e.g. an equivalent chip or software implementation) can be used without modifying the scope of the present invention. Furthermore, the device may be portable by other known methods.

I claim:

1. A waste compaction system comprising:

a portable waste compaction unit including a compactor and a waste receptacle;

a hydraulic compaction system including a vertical platen;

a hydraulic power system operatively connected to said hydraulic compaction system and comprising an electro-hydraulic conversion means for converting DC electrical power to hydraulic power, said hydraulic power system receiving power from an external battery and further comprising battery protection;

an upper opening for receiving waste product and having at least a first upper non-vertical side and a second non-vertical side, said first and second non-vertical sides opposing each other along the longitudinal axis of said portable waste compaction unit, and wherein said second non-vertical side is integral with said waste receptacle.

2. A waste compaction system as per claim 1, wherein said hydraulic compaction system further comprises a telescoping hydraulic cylinder operatively attached to said vertical platen.

3. A waste compaction system as per claim 1, further comprising an electronic circuit means to control operation of said waste compaction system.

4. A waste compaction system as per claim 3, wherein said electronic circuit means further comprises a supercharge function.

5. A waste compaction system as per claim 1, wherein said hydraulic compaction system further comprises a hydraulic manifold with multiple hydraulic fluid returns.

6. A waste compaction system comprising:

a portable waste compaction unit including a compactor and a waste receptacle;

a hydraulic compaction system including at least a telescoping hydraulic cylinder attached to a vertical platen, said hydraulic compaction system comprising a hydraulic manifold with multiple hydraulic fluid returns;

a hydraulic power system operatively connected to said telescoping hydraulic cylinder comprising an electro-hydraulic conversion means for converting DC electrical power to hydraulic power;

an electronic circuit means to control operation of said waste compaction system;

an upper opening for receiving waste product and having a first upper non-vertical side and a second non-vertical side, said first and second non-vertical sides opposing each other along the longitudinal axis of said portable waste compaction unit, and wherein said second non-vertical side is integral with said waste receptacle.

7. A waste compaction system as per claim 6, wherein said electronic circuit means further comprises a supercharge function.

8. A waste compaction system as per claim 6, wherein said hydraulic power system receives power from an external battery and said electronic circuit means further comprises battery protection.

9. A waste compaction system comprising:

a portable waste compaction unit including a compactor and a waste receptacle;

a hydraulic compaction system comprising at least a telescoping hydraulic cylinder attached to a vertical platen;

a hydraulic power system operatively connected to said telescoping hydraulic cylinder comprising;

an electro-hydraulic conversion means for converting DC electrical power to hydraulic power;

a hydraulic manifold, and wherein said hydraulic manifold includes at least a primary and secondary hydraulic fluid return.

10. A waste compaction system as per claim 9, further comprising an upper opening for receiving waste product and having a first upper non-vertical side and a second non-vertical side, said first and second non-vertical sides opposing each other along the longitudinal axis of said portable waste compaction unit.

11. A waste compaction system as per claim 9, further comprising an electronic circuit means to control operation of said waste compaction system.

12. A waste compaction system as per claim 9, wherein said electronic circuit means further comprises a supercharge function.

13. A waste compaction system as per claim 9, wherein said hydraulic power system receives power from an external battery and said electronic circuit means further comprises battery protection.

14. A waste compaction system as per claim 9, wherein said at least a primary and secondary hydraulic fluid returns are regulated by a check valve to maintain system efficiency.

* * * * *